US005578557A

United States Patent [19]

Dougan et al.

[11] Patent Number: 5,578,557

[45] Date of Patent: Nov. 26, 1996

[54] FOOD GRADE COMPRESSOR OIL

[75] Inventors: Rodney D. Dougan; Cline A. Tincher, both of Houston; Thomas F. Wulfers, Seabrook, all of Tex.

[73] Assignee: Lyondell Petrochemical Company, Houston, Tex.

[21] Appl. No.: 626,121

[22] Filed: Apr. 1, 1996

[51] Int. Cl.[6] ..... C10M 133/44

[52] U.S. Cl. ..... 508/437; 508/269

[58] Field of Search ..... 252/32.5, 33.6, 252/51.5 R

[56] References Cited

U.S. PATENT DOCUMENTS

| | | | |
|---|---|---|---|
| 3,116,252 | 12/1963 | Beretvas et al. | 252/51.5 R |
| 4,783,274 | 11/1988 | Jokinen et al. | 252/32.7 E |
| 5,344,579 | 9/1994 | Ohtani et al. | 252/51.5 R |
| 5,464,551 | 11/1995 | Deetman | 252/49.8 |
| 5,496,478 | 3/1996 | Foot et al. | 252/33.6 |

OTHER PUBLICATIONS

Article: "Lubrication of Compression Cylinders Used in the Manufacture of High–Pressure Polyethylene," *Lubrication Engineering*, vol. 37, pp. 203–208 (1980) May.

*Primary Examiner*—Jacqueline V. Howard

[57] ABSTRACT

A food grade compressor oil for use in a high pressure compressor includes a base oil, an N-acyl derivative of the amino acid sarcosine, an imidazoline, and an amine-phosphate. Each of the three additives comprises no more than 0.5% by weight of the oil composition, and results in high lubricity and very low corrosion even when water is present in the oil. The compressor oil may also include polybutene which serves as a thickener, and an antioxidant. The compressor oil of this invention is particularly well suited for use in a hypercompressor used in the manufacture of polyethylene.

22 Claims, No Drawings

FOOD GRADE COMPRESSOR OIL

FIELD OF THE INVENTION

The present invention relates to food grade lubricants, and specifically to an improved food grade oil suitable for use in hypercompressors of the type commonly used in the production of polyethylene. The hypercompressor oil of the present invention results in low frictional wear and exhibits low corrosion even with high levels of water in the oil.

BACKGROUND OF THE INVENTION

Various oil formulations have been used to lubricate equipment and reduce component wear. When operation pressures increase in equipment which generates or is subject to high fluid pressures, very tight tolerances must be maintained between the surfaces of sealed dynamic components, and accordingly good lubrication of these surfaces is a significant problem. Moreover, equipment components subject to extremely high operating pressures frequently must be fabricated from expensive materials, and repair or replacement of worn or corroded components is very costly.

One of the most difficult challenges for an equipment lubricant is presented by a hypercompressor of the type commonly used to manufacture polyethylene. Hypercompressors which employ reciprocating solid tungsten carbide or tungsten carbide coated steel rods are commonly used to compress ethylene at pressures in the range of from 35,000 to 45,000 psi to extrude beads of polypropylene. Ethylene gas is commonly sealed within the compressor by bronze tings and packing cups which receive the reciprocating rods. Replacement of these tings and packing cups may result in the shutdown of an entire polyethylene production facility. Accordingly, hypercompressor repairs and service may be very costly, both with respect to the time and expertise required to replace components, and more importantly with respect to the huge investment of polyethylene manufacturing equipment which is inactive during these repair or service operations. Further details with respect to service of a compressor used in polyethylene manufacturing, a flowchart of a typical polyethylene production operation, and lubricants for a polyethylene production compressor are disclosed in the article by Carl W. Wikelski entitled "Lubrication of Compression Cylinders Used in the Manufacture of High-Pressure Polyethylene", *Lubrication Engineering*, Vol. 37, pps. 203–208 (1980).

Although polyethylene has many uses, it is widely used in packaging and other applications where the polyethylene comes into at least incidental contact with food for human consumption. When manufacturing polyethylene for these applications, food grade lubricants must be used in the hypercompressors since the lubricant could contaminate the polyethylene and thus the food. "White oils" comprising substantially only hydrogen and carbon molecules which are commonly formed by passing hydrocarbons through a hydrogenation unit to remove aromatic groups and other possibly deleterious substances. White oils available from various manufacturers meet the approval of the U.S. Food and Drug Administration (FDA) for incidental food contact. Unfortunately, pure white oil is not an effective lubricant when used in hypercompressors, and accordingly various food grade high lubricity oils, thickeners, antioxidants, and/or catalytic initiators are commonly added to white oil to increase its performance as a lubricant when used in hypercompressors.

Oleic acid has long been added to white oil to increase its performance in hypercompressors. The addition of oleic acid enhances the wear properties of white oil by increasing the lubricant film strength. In the presence of water, however, oleic acid is corrosive on the bronze rings and packing glands used in hypercompressors. Oleic acid and water are also corrosive on the cobalt binder commonly used to adhere the tungsten carbide coating to steel rods of hypercompressors. Nevertheless, oleic acid has long been used as an additive for enhancing the properties of white oils used to lubricate hypercompressors because it is one of the few food grade additives which significantly enhances the lubricity of the white oil.

Recent research has indicated that hypercompressor repairs are frequently not the result of wear on the rings or glands, but rather the result of corrosion of the rings and glands. Corrosion of these components occurs even when relatively low levels of water are present in the oil, typically in the range of less than 200 parts per million. Moisture may be inadvertently added to the white oil through small leaks in the hydraulic system, and unfortunately most polyethylene production plants located in the United States are in the humid southwestern part of the country. Also, hydrogen peroxide is a common catalyst in polyethylene production, and water formed as a by-product in polyethylene production may contaminate the white oil. While various efforts have long been undertaken to reduce the moisture content in white oils used in hypercompressors, water content in excess of 10 parts per million in hypercompressors is nevertheless common, and even low water levels can be highly corrosive on the rings and glands at these high pressure levels.

The disadvantages of the prior art are overcome by the present invention, which significantly reduces or eliminates the use of oleic acid as a lubricity agent to make the white oil suitable for use within hypercompressors. Accordingly, the compressor oil of the present invention results in significantly less corrosion of components yet exhibits extremely low frictional wear.

SUMMARY OF THE INVENTION

A compressor oil of the present invention utilizes a food grade base oil, such as white oil, and three food grade additives which result in a lubricant with excellent lubricity and low corrosion: (1) an N-acyl derivative of the amino acid sarcosine, and preferably N-methyl-N-(1-oxo-9-octadecenyl)glycine, (2) an imidazoline, and specifically 2-(Heptadecenyl)-4,5-dihydro-1H-imidazole-1-ethanol, and (3) an aminephosphate, and specifically C11–C14 branched alkylamines, monohexyl and dihexyl phosphates. Each of these additives or any combination of two of these additives does not yield the superior result obtained by including all three additives in the base oil, as evidenced by test results set forth below.

In a preferred embodiment of the invention, the base oil comprises Duoprime 500, and also includes a thickener and an antioxidant. A suitable thickener is a lube oil additive containing polybutene, and comprises a base oil and Parapol 950. Butylated hydroxy toluene, dibutylmethylphenol, or 2,6-Di-tert-butyl-para-cresol may be used as a suitable antioxidant for including the compressor oil. In a preferred embodiment, the compressor oil comprises by weight percent from 84 to 92% base oil, from 8 to 12% a lube oil additive containing polybutene as a thickener, and less than 1% of each of an antioxidant and the three additives discussed above which together result in high lubricity and corrosion protection.

It is an object of the invention to provide an improved food grade oil suitable for use with a high pressure compressor which contains a very low percentage or no oleic acid. A related object of the invention is to provide an improved food grade oil which results in low corrosion yet has high lubricity when the oil contains water.

It is a feature of the present invention that the food grade oil contains at least three additives which together produce a desired synergistic effect of corrosion resistance and high lubricity: (1) a derivative of the amino acid sarcosine, (2) an imidazoline, and (3) an amine-phosphate. The weight percentage of each of these additives is less than 1% by volume in the compressor oil, and preferably is less than 0.5% by volume.

It is another feature of the invention to provide an improved compressor oil which is ideally suited for use within a hypercompressor of the type commonly used to compress ethylene gas and form polyethylene. The compressor oil of the present invention may contain a small amount of water, but the compressor oil is not highly corrosive on the components of the hypercompressor and results in very low wear of compressor components. Accordingly, the service life of a hypercompressor in a polyethylene manufacturing facility may be significantly increased, thereby lowering the overall costs of polyethylene production.

A significant advantage of the present invention is that the food grade oil includes additives which are readily available, and each additive is utilized in quantities which already have been approved by the Food and Drug Administration. While the food grade oil of the present invention is particularly well suited for use in compressors, and particularly in hypercompressors which generate high pressures for forming polyethylene, the oil may also be used for enhanced lubricity and reduced corrosion in other equipment, and particularly equipment wherein the lubricant needs to be food grade quality.

These and further objects, features, and advantages of the present invention will become apparent from the following detailed description.

DETAILED DESCRIPTION OF THE INVENTION

A suitable food grade lubricant according to the present invention comprises a base oil, a thickener, an antioxidant, and three additives which result in both low corrosion and high friction and wear protection. The base oil of the present invention is a white oil, and may be Duoprime 500 available from Lyondell Lubricants. A suitable thickener is a lube oil additive containing polybutene, and may be Lyondell additive R-767 which comprises by weight approximately 41% base oil and 59% Parapol 950. The compressor oil also may include an antioxidant, which may be a butylated hydroxy toluene, or dibutylmethylphenol, or 2,6-Di-tert-butyl-paracresol. A suitable antioxidant is Lyondell additive R-144.

Three additives are added to the base oil for both low corrosion and high friction and wear protection: (1) an N-acyl derivative of an amino acid sarcosine, and preferably an N-methyl-N-(1-oxo-9-octadecenyl)glycine; (2) an imidazoline, and specifically 2-(Heptadecenyl)-4,5-dihydro-1H-imidazole-1-ethanol; and (3) an aminephosphate, and preferably a C11–C14 branched alkyl amines, monohexyl and dihexyl phosphates. A suitable derivative of the amino acid sarcosine is the Sarkosyl O corrosion inhibitor which is available from Ciba-Geigy Corporation, and has a chemical formulation as follows:

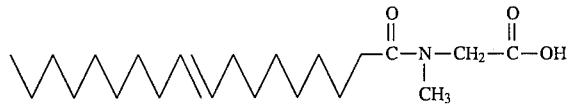

A preferred imidazoline is the Amino O corrosion inhibitor available from Ciba-Geigy Corporation, which has the chemical formula:

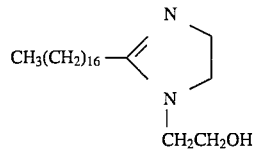

A preferred amine-phosphate is the Irgalube 349 additive of Ciba-Geigy Corporation, which has a chemical formula:

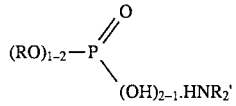

Various conventional tests are available to determine the friction characteristics of a lubricant, and specifically for evaluating lubricity and wear performance of an oil. Specific tests which are considered applicable for testing hypercompressor oils are the ASTM D4172 Wear Test, and specifically the Shell Four Ball Test, the Wear Index, and the Weld Point Test each described in detail in ASTM accepted procedures. These ASTM procedures resulted in the Four Ball Wear, Weal Index and Weld Point measurements shown in Table I.

In order to evaluate the corrosion resistance property of hypercompressor oils, a test method was developed to evaluate the corrosion of copper, iron, and lead when exposed to a compressor oil/water mixture. According to this test, 500 ml. of a test oil and 50 ml. of distilled water were placed in a 600 ml. beaker. Corrosion tests were performed on test coupons fabricated from R 401-A copper, R 401-B steel, and R 401-Pb lead each purchased from Meta-Spec in San Antonio, Tex. Three one-inch square coupon sheets of copper, iron and lead were attached to a gas inlet tube of the type used in the ASTM D 943 Turbine Oil Oxidation Stability Test, and the three coupons were then suspended in the test oil. The test oil/water was heated to 140° F. on a Thermoline stirring hot plate, and a magnetic stirrer was placed in the mixture. The stir rate was set at 153 rpm for 48 hours. At the end of each test, the coupons were removed from the oil-water mixture, and the coupons were each cleaned in a 1:1:1 mixture of isooctane, toluene and isopropyl alcohol. Each coupon was then weighed to the nearest milligram, and the weight loss recorded.

The results of the tests conducted to date are set forth in Table I. Sample No. 1 utilized 3% by weight oleic acid. The corrosive effect of the oleic acid, particularly on the lead coupon, is demonstrated by the high weight loss. The wear test measurements for Sample No. 1 with 3% by weight oleic acid (no other additives) provided fair results, although a lower four ball wear measurement and a higher weld point measurement are desirable for a hypercompressor oil. The weight loss of only the base oil and water (no additives) understandably produced acceptable corrosion results, although the better four ball wear and weld point values measurements are desired for a hypercompressor oil. The test labeled PHLA 1500 utilized a sample of a competitive compressor oil which also contains oleic acid. The weight loss of lead for this sample test was considered unacceptable.

In Sample No. 8, methyl oleate was substituted for the oleic acid of Sample No. 1. The corrosion was significantly reduced but was still undesirably high. The wear test data for Test No. 8 was considered unacceptable. In Sample Nos. 6C, 6D, and 6E, the Amine-O, Sarkosyl O, and Irgalube 349 additives each at 1% by weight were tested. The weight loss in both Sample Nos. 6C and 6E was significantly reduced compared to the Sample No. 1, particularly for lead. While the test results are interesting, an acceptable compressor oil is not suggested by these tests since, as previously explained, the maximum weight percent of each of these additives in a commercially acceptable compressor oil is 0.5% in accordance with FDA standards. Acceptable levels of Irgalube 349 were tested in Sample Nos. 751-3, 751-4 and 751-5. The wear test results and the weld point measurements of 160 Kg for Sample Nos. 751-3 and 751-4 are considered unacceptable for hypercompressor oil. The results of Sample No. 751-5 are considered erroneous, since the weight percent of Irgalube 349 was reduced compared to both Test Nos. 751-3 and 751-4, although no weight loss was measured and the wear test results are acceptable.

In Sample No. 4, Sarkosyl O was substituted for part of the oleic acid. Corrosion was reduced compared to Sample No. 1, although corrosion was still considered unacceptably high. Sample No. 10 included 0.1% by weight Rheomet in addition to 3% by weight oleic acid, and both weight loss due to corrosion and the overall wear were considered unacceptable. In Sample No. 12, a small amount of Irgalube 349 was added to the sample with 3% by weight oleic acid, and resulted in increased weight loss compared to Sample No. 1.

Sample Nos. 14 and 18 added Amine-O to test samples with 3% by weight oleic acid. Sample Nos. 9, 13, and 19 tested different combinations of oleic acid, Sarkosyl O, and Amine-O. In Sample Nos. 11 and 22, methyl oleate and Amine-O were added to oleic acid. Sample No. 21 included oleic acid, methyl oleate, and Sarkosyl O, and Test No. 23 included oleic acid, methyl oleate, Amine-O, and Sarkosyl O. None of these tests resulted in acceptable corrosion weight losses. Sample No. 5 utilized Sarkosyl O and Irgalube 349 as additives, and Sample No. 15 used methyl oleate and Amine-O as additives. Corrosion was too high for Sample No. 5, and both corrosion and wear test data were unacceptable for Sample No. 15.

The results of Sample Nos. 751-1 and 751-6 utilized combinations of Amine-O, Sarkosyl O, Irgalube 349 each in weight percent equal to or less than 0.5% are particularly encouraging. The results of Sample No. 751-1 which included 0.5% by weight of each additive are quite surprising. The results of the same additives of Sample Nos. 6 and 6A are less impressive, although the weight loss is still considered acceptable. The addition of Rheomet 39 to the combination of these three additives as shown in Sample No. 6B did not produce any detectable benefit.

Sample No. EC 691 included the three additives of Sample No. 751-1, and also 0.5% by weight Lyondell additive R-144 which serves as an antioxidant, and 9.9% by weight Lyondell additive R-767 which functions as a thickener. These further additives increased corrosion slightly, although the test results are still highly favorable when compared to Sample No. 1 or Sample PHLA 1500.

TABLE I

CORROSION TEST AND FRICTION AND WEAR TEST RESULTS

| | | | | | | Wear Test (ASTM D4172) | | |
|---|---|---|---|---|---|---|---|---|
| | Wt | | Wt Loss (mgs) | | | Wear (4 Ball) | Wear Index | Weld Point |
| Sample # | % | Additive | Cu | Fe | Pb | (in) | (KgF) | (Kg) |
| 1 | 3.0 | Oleic Acid | 7 | 1 | 983 | 0.62 | 28.64 | 160 |
| Base Oil | | | 0 | 0 | 4 | 0.57 | 22.62 | 160 |
| PHLA 1500 | | | 1 | 0 | 159 | 0.50 | 27.24 | 200 |
| 8 | 3.0 | Methyl Oleate | 0 | 3 | 163 | 0.50 | 22.42 | 160 |
| 6C | 1.0 | Amine-O | 5 | 1 | 1 | 0.48 | 22.80 | 200 |
| 6D | 1.0 | Sarcosyl O | 7 | 48 | 254 | 0.50 | 26.19 | 126 |
| 6E | 1.0 | I-349 | 1 | 1 | 1 | 0.30 | 49.54 | 200 |
| 751-3 | 0.5 | I-349 | 0 | 0 | 0 | 0.35 | 27.11 | 160 |
| 751-4 | 0.3 | I-349 | 0 | 0 | 6 | 0.37 | 22.18 | 160 |
| 751-5 | 0.1 | I-349 | 0 | 0 | 0 | 0.30 | 28.13 | 200 |
| 4 | 1.5 | Oleic Acid | 30 | 31 | 326 | | | |
| | .05 | Sarcosyl O | | | | | | |
| 10 | 3.0 | Oleic Acid | 0 | 0 | 696 | 0.65 | | |
| | 0.1 | Rheomet 39 | | | | | | |
| 12 | 3.0 | Oleic Acid | 39 | 10 | 1091 | | | |
| | 0.075 | I-349 | | | | | | |
| 14 | 3.0 | Oleic Acid | 2 | 1 | 1075 | | | |
| | 0.05 | Amine-O | | | | | | |
| 18 | 3.0 | Oleic Acid | 4 | 0 | 742 | | | |
| | 0.15 | Amine-O | | | | | | |
| 9 | 1.0 | Oleic Acid | 9 | 0 | 353 | | | |
| | 0.5 | Sarcosyl O | | | | | | |
| | 0.5 | Amine-O | | | | | | |
| 13 | 3.0 | Oleic Acid | 2 | 0 | 640 | | | |
| | 0.05 | Amine-O | | | | | | |
| | 0.075 | Sarcosyl O | | | | | | |
| 19 | 1.0 | Oleic Acid | 5 | 2 | 568 | | | |
| | 0.5 | Sarcosyl O | | | | | | |
| | 0.5 | Amine-O | | | | | | |
| 11 | 3.0 | Oleic Acid | 0 | 3 | 163 | 0.50 | 22.42 | 160 |
| | 3.0 | Methyl Oleate | | | | | | |

TABLE I-continued

CORROSION TEST AND FRICTION AND WEAR TEST RESULTS

| | | | | | | Wear Test (ASTM D4172) | | |
|---|---|---|---|---|---|---|---|---|
| | Wt | | Wt Loss (mgs) | | | Wear (4 Ball) | Wear Index | Weld Point |
| Sample # | % | Additive | Cu | Fe | Pb | (in) | (KgF) | (Kg) |
| | 0.5 | Amine-O | | | | | | |
| 22 | 1.0 | Oleic Acid | 22 | 5 | 457 | 0.49 | 22.47 | 160 |
| | 1.0 | Methyl Oleate | | | | | | |
| | 0.5 | Amine-O | | | | | | |
| 21 | 1.0 | Oleic Acid | 9 | 2 | 674 | 0.51 | | |
| | 1.0 | Methyl Oleate | | | | | | |
| | 0.075 | Sarcosyl O | | | | | | |
| 23 | 1.0 | Oleic Acid | 6 | 3 | 508 | | | |
| | 1.0 | Methyl Oleate | | | | | | |
| | 0.5 | Amine-O | | | | | | |
| | 0.5 | Sarcosyl O | | | | | | |
| 5 | 0.5 | Sarcosyl O | 1 | 15 | 384 | | | |
| | 0.5 | I-349 | | | | | | |
| 15 | 3.0 | Methyl Oleate | 10 | 5 | 21 | 0.56 | | |
| | 0.05 | Amine-O | | | | | | |
| 751-1 | 0.5 | Amine-O | 0 | 0 | 0 | 0.23 | 23.59 | 200 |
| | 0.5 | Sarcosyl O | | | | | | |
| | 0.5 | I-349 | | | | | | |
| 751-6 | 0.3 | Amine-O | 0 | 0 | 0 | 0.31 | 17.6 | 125 |
| | 0.3 | Sarcosyl O | | | | | | |
| | 0.5 | I-349 | | | | | | |
| 6 | 0.5 | Sarcosyl O | 2 | 0.6 | 85 | | | |
| | 0.5 | I-349 | | | | | | |
| | 0.5 | Amine-O | | | | | | |
| 6A | 0.5 | Amine-O | 1 | 1 | 14 | 0.32 | 27.96 | 200 |
| | 0.5 | Sarkosyl O | | | | | | |
| | 0.5 | I-349 | | | | | | |
| 6B | 0.5 | Amine-O | | | | 0.29 | 27.35 | 160 |
| | 0.5 | Sarcosyl O | | | | | | |
| | 0.5 | I-349 | | | | | | |
| | 0.5 | Rheomet 39 | | | | | | |
| EC 691 | 0.5 | Amine-O | 3 | 0 | 32 | | | |
| | 0.5 | Sarcosyl O | | | | | | |
| | 0.5 | I-349 | | | | | | |
| | 0.5 | R144 | | | | | | |
| | 9.9 | R-767 | | | | | | |

Oleic acid and similar fatty acids are considered effective additives in hydrodynamic and low pressure lubrication applications because of their strong attraction to metal surfaces. Oleic acid accordingly forms a low friction, tenacious mono-molecular-layer film on the metal surface which minimizes or prevents metal-to-metal contact and thus wear. As explained earlier, however, moisture leads to an ionization of oleic acid and to the formation of metal salt. These salts lower the pH of the oil, and are generally not as oil soluble or as strongly attracted to the metal surfaces. The high pressure action of the hypercompressor removes the salt, resulting in the removal of the metal surfaces of the hypercompressor, i.e. , corrosion.

When Sarkosyl O, another fatty acid, is substituted for all or part of the oleic acid, good lubricity may be expected, although tests indicated that the corrosion was not significantly reduced or eliminated. When methyl oleate, a non-acid fatty material, is substituted for all or part of the oleic acid, corrosion may be reduced or eliminated, but the desired high lubricity is not obtained. A surfactant material such as Amine-O provides both high lubricity and low corrosion. The addition of Irgalube 349 should provide high lubricity, but this additive alone may result in unacceptable corrosion due to its acidity.

The use of Sarkosyl O significantly reduces but does not eliminate corrosion. Because there is a second highly polar part of the molecule, Sarkosyl O should have two points of attachment to the metal surface, making it more difficult for this molecule to form a metal salt and remove the metal (corrode the surface). Because of its two point attachment, the Sarkosyl O molecule may not be as easily moved free of the metal surface as oleic acid, thereby reducing corrosion. The addition of Irgalube 349 appears to show the same significant corrosion protection. Again, this may be due to the effect of more than one polar area of this molecule. The addition of Irgalube 349 was not, however, completely effective by itself and did not totally eliminate the corrosive action. The addition of Amine-O formulations containing Sarkosyl O did not completely resolve the problem. Surprisingly, however, the combination of Sarkosyl O, Amine-O, and Irgalube 349 gave acceptable corrosion results. These test results strongly indicate that the combination of Sarkosyl O, Amine-O, and Irgalube 349, each at or below the weight percent permitted by the FDA, will provide acceptable or superior corrosion results for a hypercompressor oil. Based on the friction and wear tests for an oil with these three additives, this food grade oil for use in a hypercompressor will result in appreciably lower friction and wear than the commercially available alternative hypercompressor oils.

The reason why this particular combination of additives yields superior results is not fully understood. It is believed that this combination forms an associative polymer on the surface of the metal, and that this polymer involves all the polar areas of the molecules and intermolecular association in order to reliably attach the molecules to the metal surface. The coating may be so strongly attracted to the metal surface so that it is not practically removed by the action of the hypercompressor. The coating formed by these additives thus effectively protects the metal surface from corrosion and provides the desired lubricity for this lubricant application.

A food grade hypercompressor oil according to the present invention comprises white oil which serves as the base oil, and three additives each with a weight percent of more than 0.5%: (1) an N-acyl derivative of the amino acid sarcosine, (2) an imidazoline, and (3) an amine-phosphate. A preferred chemical structure for each of these three additives is discussed above. The composition also preferably includes from 0.2% to no more than 0.5% by weight an antioxidant selected from the group consisting of butylated hydroxy toluene, dibutylmethylphenol, and 2,6-Di-tert-butyl-para-cresol. Finally, the composition preferably includes a thickener oil, which may comprise from about 6% to about 14% by weight of the composition, and preferably about 10% by weight of the composition. A preferred thickener comprises about 41% by weight a base oil and 59% by weight polybutene. A suitable antioxidant is the Lyondell R-144 additive, and a suitable thickener is the Lyondell R-767 additive. The oil composition contains less than 0.1% by weight oleic acid, and preferably contains no oleic acid. A presently preferred hypercompressor oil composition comprises from 84% to 92% by weight of oil, from 7% to 14% by weight a thickener oil, from 0.2% to 0.5% by weight each of an antioxidant, an N-acyl derivative of the amino acid sarcosine, an imidazoline, and an amine-phosphate.

The last three additives discussed above provide low frictional wear and low corrosion for a hypercompressor oil even when water generally in a range of from 50 to 150 parts per million or higher is present in the oil. Both the oil thickener and the antioxidant are preferably used to provide desirable characteristics for a hypercompressor oil. Each additive is used in an amount satisfactory according to FDA regulations, and each additive has already been approved for use in a compressor oil. The food grade compressor oil of the present invention is particularly well suited for use in high pressure compressor, and particularly a hypercompressor used in the production of polyethylene.

Those skilled in the art will understand that by mixing the white oil with the three additives discussed in detail above, a food grade oil composition may be formed which has high lubricity and exhibits low corrosion even with water in the oil. Depending upon the particular use for the oil, various other additives may be included in the composition. For example, for a compressor oil particularly well suited for use in a hypercompressor utilizing the manufacture of polyethylene, the composition with the three additives may also include an antioxidant and a thickener as described above.

The foregoing disclosure describes preferred embodiments of the present invention. In view of this description, various changes and modifications may be suggested to one skilled in the art. For example, additional additives may be added to the above composition to achieve additional desired characteristics for a food grade composition. Accordingly, such changes and modifications should be considered within the scope of the invention, which is defined by the claims.

What is claimed is:

1. A food grade oil composition for use in a high pressure compressor, the oil composition comprising:

a base oil;

an N-acyl derivative of the amino acid sarcosine;

an imidazoline; and an amine-phosphate.

2. The food grade compressor oil as defined in claim 1, wherein the N-acyl derivative of the amino acid sarcosine comprises N-methyl-N-(1-oxo-9-octadecenyl) glycine.

3. The food grade compressor oil as defined in claim 1, wherein the imidazoline comprises 2-(Heptadecenyl)-4,5-dihydro-1H-imidazole-1-ethanol.

4. The food grade compressor oil as defined in claim 1, wherein the amine-phosphate comprises a C11–C14 branched alkylamines, monohexyl and dihexyl phosphates.

5. The food grade compressor oil as defined in claim 1, further comprising:

an oil additive containing polybutene.

6. The food grade compressor oil as defined in claim 1, further comprising:

an antioxidant selected from a group consisting of butylated hydroxy toluene, dibutylmethylphenol, and 2,6-Di-tert-butyl-para-cresol.

7. The food grade compressor oil as defined in claim 1, wherein the oil composition contains less than 0.1% by weight oleic acid.

8. The food grade compressor oil as defined in claim 1, wherein each of the N-acyl derivative of the amino acid sarcosine, the imidazoline, and the aminephosphate comprises no more than 0.5% by weight of the oil composition.

9. The food grade compressor oil as defined in claim 1, wherein each of the N-acyl derivative of the amino acid sarcosine, the imidazoline, and the aminephosphate comprises from 0.2 to 0.5% by weight of the oil composition.

10. The food grade compressor oil as defined in claim 1, wherein the base oil is a white oil comprising from 84% to 92% by weight of the oil composition.

11. A food grade oil composition, comprising:

a white oil;

an N-acyl derivative of the amino acid sarcosine comprising no more than about 0.5% by weight of the oil composition;

an imidazoline comprising no more than about 0.5% by weight of the oil composition; and an amine-phosphate comprising no more than about 0.5% by weight of the oil composition.

12. The food grade compressor oil as defined in claim 11, wherein:

the N-acyl derivative of the amino acid sarcosine comprises N-methyl-N-(1-oxo-9-octadecenyl)glycine;

the imidazoline comprises 2-(Heptadecenyl)-4,5-dihydro-1H-imidazole-1-ethanol; and the amine-phosphate comprises a C11–C14 branched alkylamines, monohexyl and dihexyl phosphates.

13. The food grade compressor oil as defined in claim 11, further comprising:

an oil additive containing a base oil and polybutene.

14. The food grade compressor oil as defined in claim 11, further comprising:

an antioxidant comprising no more than 0.5% by weight of the oil composition and selected from a group consisting of butylated hydroxy toluene, dibutylmethylphenol, and 2,6-Di-tert-butyl-para-cresol.

15. The food grade compressor oil as defined in claim 11, wherein the oil composition contains less than 0.1% by weight oleic acid.

16. The food grade compressor oil as defined in claim 11, wherein each of the N-acyl derivative of the amino acid sarcosine, the imidazoline, and the aminephosphate comprises from 0.2 to 0.5% by weight of the oil composition.

17. A food grade oil composition, comprising:

a base oil comprising at least 84% by weight of the oil composition;

an N-acyl derivative of the amino acid sarcosine comprising from 0.2% to 0.5% by weight of the oil composition;

an imidazoline comprising from 0.2% to 0.5% by weight of the oil composition;

an amine-phosphate comprising from 0.2% to 0.5% by weight of the oil composition;

an antioxidant; and a thickener.

18. The food grade compressor oil as defined in claim 17, wherein the N-acyl derivative of the amino acid sarcosine comprises N-methyl-N-(1-oxo-9-octadecenyl)glycine.

19. The food grade compressor oil as defined in claim 17, wherein the imidazoline comprises 2-(Heptadecenyl)-4,5-dihydro-1H-imidazole-1-ethanol.

20. The food grade compressor oil as defined in claim 17, wherein the amine-phosphate comprises a C11–C14 branched alkylamines, monohexyl and dihexyl phosphates.

21. The food grade compressor oil as defined in claim 17, wherein the antioxidant comprises no more than 0.5% by weight of the oil composition and is selected from a group consisting of butylated hydroxy toluene, dibutylmethylphenol, and 2,6-Di-tert-butyl-para-cresol.

22. The food grade oil as defined in claim 17, wherein the thickener comprises polybutene.

* * * * *

UNITED STATES PATENT AND TRADEMARK OFFICE

CERTIFICATE OF CORRECTION

PATENT NO. : 5,578,557
DATED : November 26, 1996
INVENTOR(S) : Dougan, et. al.

It is certified that error appears in the above-identified patent and that said Letters Patent is hereby corrected as shown below:

Title page, item [73], Assignee: should read-- Lyondell-Citgo Refining Company Ltd., Houston, Texas--

Signed and Sealed this

Tenth Day of February, 1998

*Attest:*

Bruce Lehman

BRUCE LEHMAN

*Attesting Officer*

*Commissioner of Patents and Trademarks*